US006328615B1

(12) United States Patent
Safai

(10) Patent No.: US 6,328,615 B1
(45) Date of Patent: Dec. 11, 2001

(54) CONTACT FORMED OF JOINED PIECES

(75) Inventor: Sohrab Safai, Laguna Niguel, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/517,710

(22) Filed: Mar. 2, 2000

(51) Int. Cl.[7] ..... H01R 11/22
(52) U.S. Cl. ..... 439/851; 439/825
(58) Field of Search ..... 439/879, 891, 439/851, 825

(56) References Cited

U.S. PATENT DOCUMENTS

| | | | |
|---|---|---|---|
| 1,835,000 | 12/1931 | Berthold . | |
| 2,689,337 | 9/1954 | Burtt et al. | 339/217 |
| 3,026,496 | 3/1962 | Gluck | 339/193 |
| 3,079,582 | 2/1963 | Lazar | 339/217 |
| 3,544,954 | 12/1970 | Yeager | 339/217 |
| 3,641,483 | 2/1972 | Bonhomme | 339/217 |
| 4,031,614 | 6/1977 | Gipe | 29/630 |
| 4,461,531 | 7/1984 | Davis et al. | 339/258 |
| 4,645,278 | 2/1987 | Yevak, Jr. et al. | 339/17 |
| 4,780,097 | 10/1988 | Piscitelli | 439/843 |
| 5,106,328 | 4/1992 | Prochaska et al. | 439/751 |
| 5,387,138 | 2/1995 | O'Malley | 439/751 |
| 5,419,723 | 5/1995 | Villiers et al. | 439/843 |
| 5,489,223 | 2/1996 | Faje et al. | 439/748 |

FOREIGN PATENT DOCUMENTS 1388666 7/1963 (FR) .

*Primary Examiner*—P. Austin Bradley
*Assistant Examiner*—Briggette R. Hammond
(74) *Attorney, Agent, or Firm*—Roger C. Turner

(57) ABSTRACT

A contact is formed of a terminus (12) that forms the rear termination end of the contact, and a mater (14) that forms the front contact mating end such as a socket (32) or pin, the front of the terminus being joined to the rear of the mater. The terminus front portion forms a groove (42, 138) and the mater rear end has a part (50, 154) that lies in the groove and is locked therein. The maters can be completely gold plated while the terminus is not plated at all, to minimize the use of gold while avoiding the need for masks to selectively plate only portions of a unitary contact. In one contact design, the groove (138) at the front end of the terminus opens forwardly (F) and is formed by concentric inner and outer groove walls (140, 142), with the rear end of the terminus having a cylindrical part (154) that fits into the groove with a press fit and/or crimp of the outer groove wall. In another contact construction, the groove (42) opens radially outward (O) and the rear end of the terminus forms a radially inwardly projecting flange (50) that lies in the groove.

10 Claims, 4 Drawing Sheets

CONTACT FORMED OF JOINED PIECES

BACKGROUND OF THE INVENTION

Contacts are commonly formed by machining a piece of metal to form a tubular rear end that can receive and crimp or solder to a wire, and a front mating end that forms a pin or socket. Several different types of contacts are required, including those with pin mating ends, those with socket mating ends, and those with mating and termination ends designed for solder, crimp, or pc tail connections. The machining of an entire contact results in considerable cost, and the need to keep several different contact types in inventory further increases the cost. In many cases, it is desirable to gold plate the mating end of the contact. If this is done by plating the entire contact, the cost of the gold increases, while if only the mating end is to be plated then there is a cost for masking the rest of the contact. Contacts which could be constructed at moderate cost and which were then available in different versions with minimum inventory, would be of value.

SUMMARY OF THE INVENTION

In accordance with one embodiment of the present invention, a contact is provided with a mating end for releaseably mating to another contact and with a termination end for permanent attachment to a conductor, which can be constructed at moderate cost and in a manner that minimizes the amount of inventory required to provide contacts of slightly different types. The contact includes a terminus and a separate mater. The terminus has a rear portion for termination to a conductor, as by forming a tube that receives a wire or other conductor to solder or crimp to it, or by forming a pin that projects through a plated hole of a circuit board. The terminus has a front end forming a groove. The mater has a front portion forming a socket, pin, or other mating end for mating to another contact, and has a rear that fits into the groove in the terminus and that is locked in the groove. This allows gold plating of only about half of the entire contact, by gold plating all of the area of the mater. Also, slightly different termini and maters can be joined together to provide a variety of slightly different contacts.

In one contact, the groove at the front of the terminus opens forwardly, while the rear end of the mater slides axially into the groove and is locked therein. Locking can be accomplished by providing a press fit insertion of the mater rear end into the groove and/or by crimping the front end of the terminus to crimp the walls of the groove. In another contact, the groove opens radially outward, and the rear of the mater has a radially-inwardly-extending flange that lies in the groove. Where the mater is formed of sheet metal that has been bent into a largely cylindrical shape, insertion of at least a mater into a passage of an insulator of a connector, prevents the rear end of the mater from expanding radially out of the groove that opens radially outwardly.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
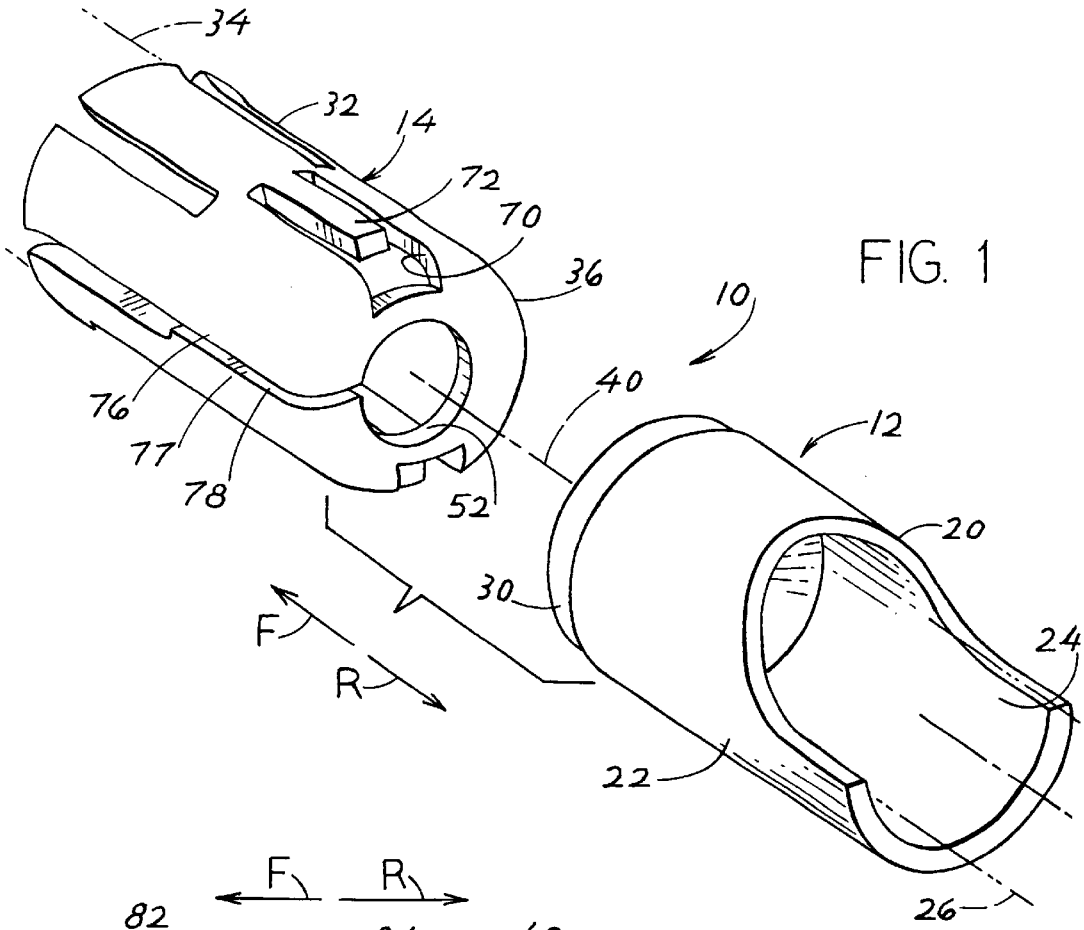
FIG. 1 is an exploded isometric view of a contact constructed in accordance with one embodiment of the invention.

FIG. 1 shows a contact 10 which includes two separate parts, these being a contact terminus 12 and a contact mater 14. The terminus has a rear portion 20 that forms a tube 22 with an open rear end 24. The tube is designed to receive a conductor 26 such as a wire, and permanently attach to it, as by soldering or by crimping of the tube. The particular tube 20 is best used as a solder cup. The terminus has a front portion 30 which is designed to connect to the mater 14. The mater 14 has a front portion 32 that is designed to releaseably mate with another contact. The particular front portion 32 forms a socket which is designed to receive a mating pin contact 34. The mater has a rear portion 36 that is designed to connect to the terminus front portion 30. When connected, the terminus and mater each lies on a contact axis 40.

Figure 2:
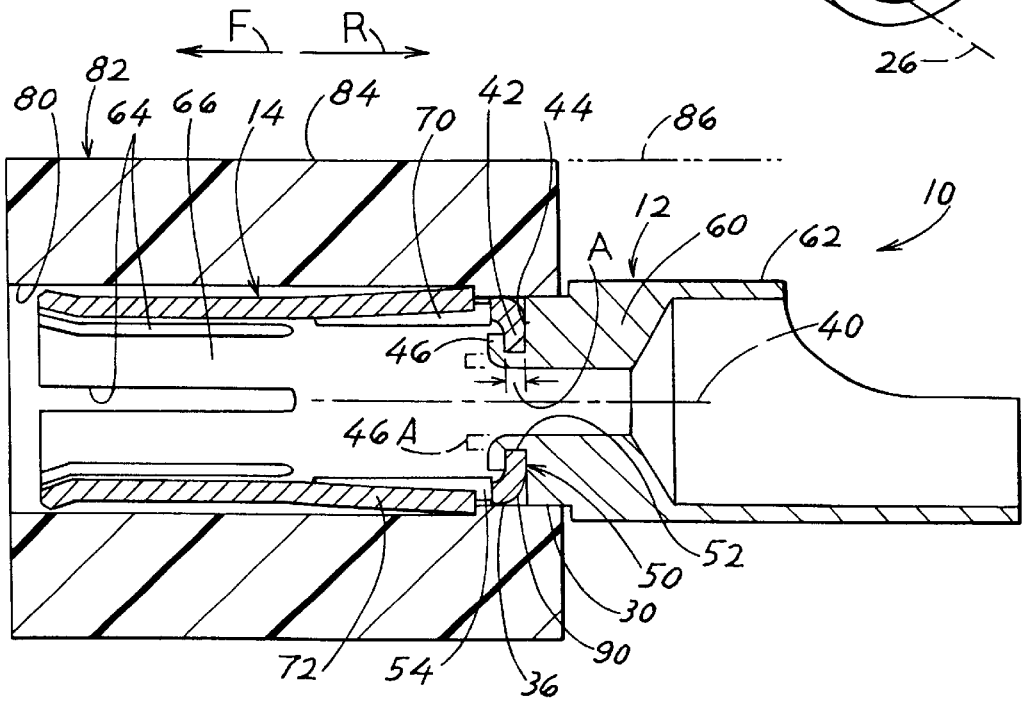
FIG. 2 is a sectional view of the assembled contact of FIG. 1, with a portion shown installed in the passageway of an insulator.

FIG. 2 shows that the front portion 30 of the terminus 12 forms a groove 42 that opens in a radially outward direction, with respect to the axis 40. The groove has a pair of axially-spaced groove walls 44, 46 that form the groove 42 between them. The mater rear portion 36 forms a flange 50 that extends radially inwardly and that has a free radially inward end 52. The radially outer part 90 of the flange connects to a mater part 54 that has a larger diameter than the radially inner end 52 of the flange. The flange lies in the groove 42. This prevents the terminus and mater from separating, so they hold together. The flange 50 lies in a press fit in the groove.

The terminus 12 is formed from a piece of metal stock that is machined to its final shape, except that groove wall 46 initially extends axially, as shown at 46A. With the mater positioned as shown in FIG. 2, a swaging tool is inserted through the inside of the mater and the wall 46A is bent 90° to the position shown at 46, while tightly sandwiching the flange 50 between the groove walls 44, 46. The fact that the terminus is a machined part is obvious from the fact that certain locations such as at 60 are much thicker than other locations such as 62 and has circular machining marks. Also, the machined part extends 360° about the axis 40, without a gap in it.

The mater 14 is formed from a piece of sheet metal. A piece of sheet metal is stamped from a larger sheet, with slots at 64 that form fingers 66 of a socket contact end, and with slots at 70 that form retention tines 72 that retain the contact in an insulator. Also, the rear end of the piece of sheet metal has been bent to form the radially inwardly-extending flange 50. The piece of sheet metal has largely parallel adjacent edges 76, 77. It is obvious from examining the part, that it is formed from sheet metal, because of the uniform thickness of the metal, even though some portions of the sheet metal can be slightly reduced in thickness.

FIG. 2 shows the contact 10 installed forwardly F in a passage 80 of an insulator 82. Only a front portion 84 of the insulator is shown in solid lines, with a rear portion 86 extending rearwardly R from the front portion. It can be seen that the radially outer end 90 of the flange is closely surrounded by the insulator part 84. This prevents the flange from expanding and coming out of the groove 42, although the press fit of the flange 50 between the groove walls 44, 46 prevents this.

It is often desirable to provide a gold plating on the inside surface of the fingers 66 of the contact mater 14. To reduce the amount of gold that is used so as to decrease the cost, is common to provide a mask that covers most of the surface of the contact so it is not plated. Applicant prefers to plate the entire mater 14, which avoids the need for a mask. Since the terminus 12 is separate from the mater until they are joined in the final contact, only the mater 12 is plated. As a result, perhaps twice as much gold is used as for a prior one-piece contact, but only half as much gold is used than would be used if an entire one-piece prior contact were completely plated without masking. The ability to plate without masking, lowers the cost.

Instead of using a mater 14 with a socket front portion, it is possible to use a mater with a pin-type front portion, wherein the front portion is bent to form a largely closed front end. Also, slightly different termini can be called for, such as one with a tube in the form of a cylinder without the solder cup cutout of FIGS. 1 and 2 for better crimping, or a pin for insertion into a circuit board hole. Also, termini and maters of different lengths may be required. Because of the fact that applicant provides two pieces that are joined to form a contact, applicant can provide a variety of different contacts using a relatively small number of different types of termini and maters. That is, a terminus with the desired terminal rear portion can be attached to a mater with the desired mating front portion to form the desired contact.

Figure 3:
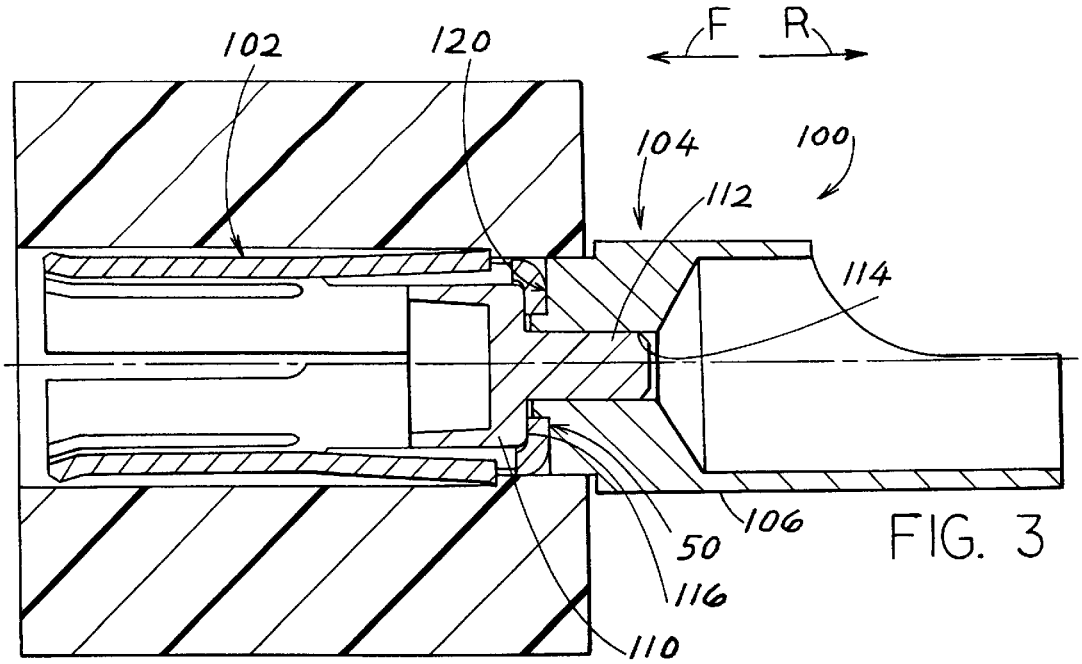
FIG. 3 is a sectional view of an assembled contact of a second embodiment of the invention.

FIG. 3 shows a contact 100 that includes a one-piece contact mater 102 and a two-piece contact terminus 104. The mater 102 is of the same construction as in FIGS. 1 and 2. However, the terminus 104 includes a main terminus part 106 and a separate fastener 110. The main terminus part 106 is of the same construction as in FIGS. 1 and 2 except that it does not have a groove forward wall. Instead, when the flange 50 is installed as shown, the fastener 110 is moved rearwardly through the inside of the mater 102 until a shaft 112 of the fastener moves into a hole 114 in the main terminus part, with the shaft being in interference fit with the walls of the hole 114. A rearwardly-facing shoulder 116 on the fastener then presses against the front face of the flange 50 to compress it against a rear surface or wall 120 of the groove, to trap the flange and therefore the mater in place in a crimp type connection. Although the use of the fastener 110 requires an additional part, it can result in a stronger connection between the mater and terminus, and is preferred over the contact 10 of FIG. 2.

Figure 4:
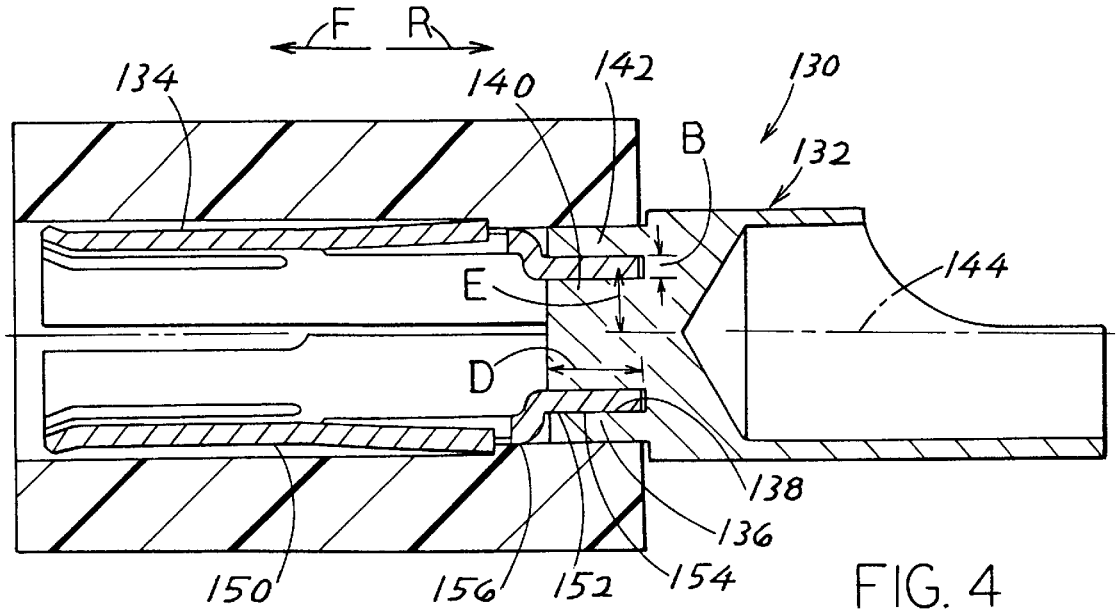
FIG. 4 is a sectional view of an assembled contact of a third embodiment of the invention.

FIG. 4 shows a contact 130 that includes a contact terminus 132 and a contact mater 134 of modified construction. The terminus 132 has a front portion 136 that forms a forwardly-opening groove 138. The groove has radially inner and outer walls 140,142 with the groove between them, the groove being centered on the axis 144. The mater 134 has a front middle portion 150 and has a rear portion 152. The rear portion 152 forms a cylinder 154 of the same diameter as that of the groove 138, to fit into the groove when the mater 134 is moved rearwardly R and/or the terminus 132 is moved forwardly F. The cylinder 154 is of smaller diameter than the diameter at 156 at the front of the rear portion 152 and at the rear of the front middle portion 150. The thickness B of the cylinder 154 is preferably slightly greater than the thickness of the groove 138, to provide an interference or press fit. Instead or in addition, the outer wall 142 of the groove can be crimped to fix the cylinder 154 in place.

The length of the axially-extending groove 138 is not limited, as is a radially-extending groove. As a result, a reliable connection between the mater cylinder 154 and walls of the terminus groove 138 can be achieved by a moderately long groove whose length D is at least the radius E of the groove as measured from the axis 144. This permits a reliable connection using only two parts, and this embodiment of the invention is generally preferred over those of FIGS. 2 and 3.

Figure 5:
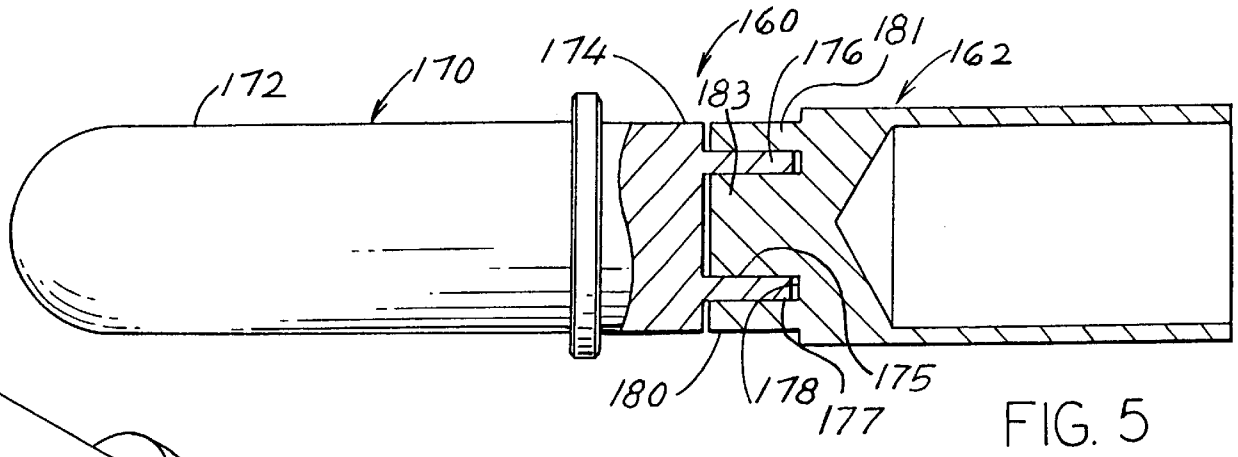
FIG. 5 is a partial sectional view of a contact of a fourth embodiment of the invention.
Figure 6:
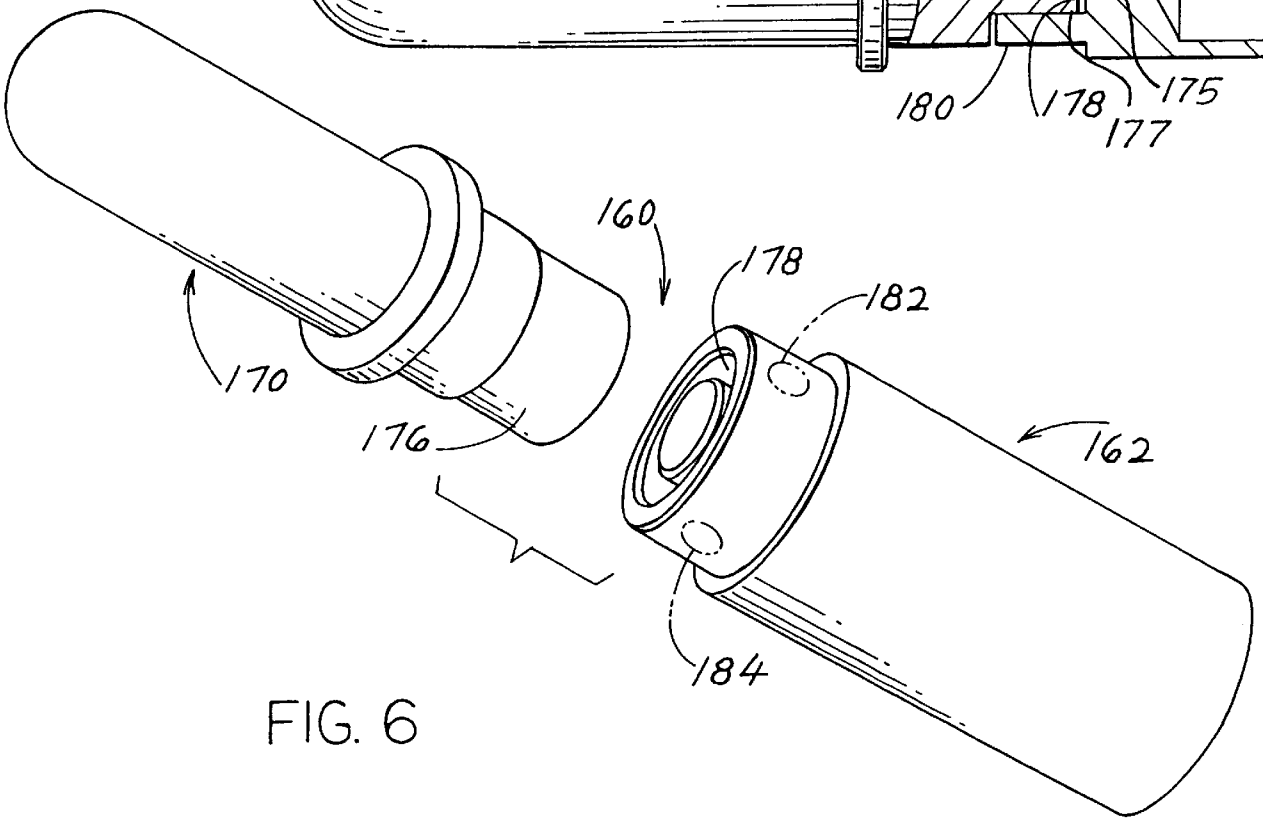
FIG. 6 is an exploded isometric view of the contact of FIG. 5.

FIGS. 5 and 6 show a contact 160 with a terminus 162 of the same construction as in FIG. 4 but with a different mater 170. The mater 170 has a front portion 172 that forms a pin, and is a machined part rather than a part formed of sheet metal. The mater rear portion 174 forms a cylinder 176 with inner and outer faces 175, 177 that fits into a groove 178 at the front of the terminus. The terminus front end has a pair of walls 181, 183 that form the groove 178. As in FIG. 4, the cylinder 176 preferably has a press fit into the groove, and the outer wall 180 can be crimped around the cylinder 176 to further fix it in place. FIG. 6 shows two of three crimp locations 182, 184 where the terminus front portion would be crimped to form an indentation at those locations.

Figure 7:
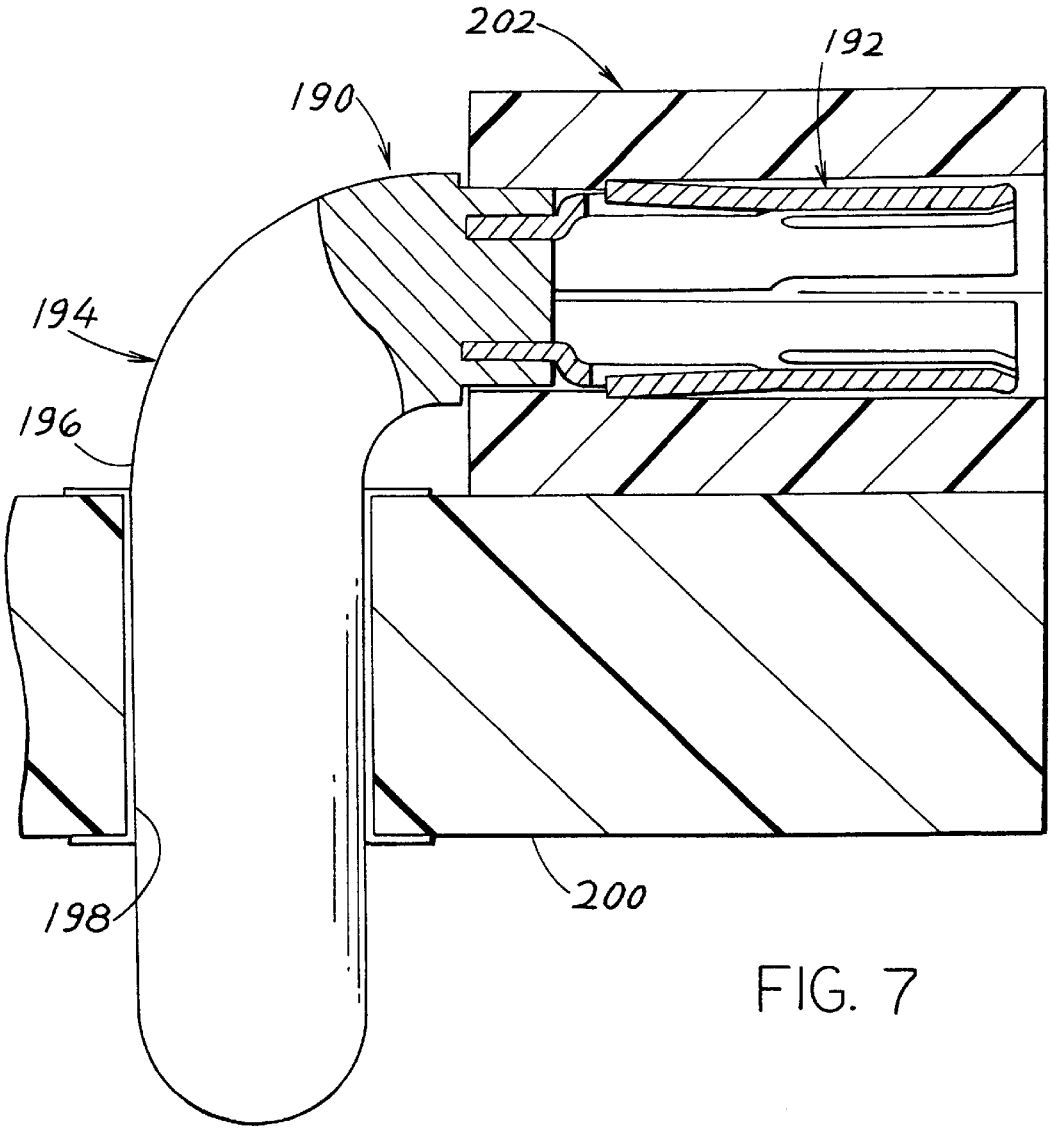
FIG. 7 is a partially sectional view of a contact of a fifth embodiment of the invention.

FIG. 7 shows a contact 190 with a contact mater 192 of the same construction as that of FIG. 4, but with a contact terminus 194 of modified construction. The terminus 194 has a rear end 196 in the form of a pin with a 90° bend. The pin projects through a plated hole 198 in a circuit board 200 and is soldered in place. The insulator 202 that surrounds the mater, forms a connector that opens parallel to the plane of the circuit board.

Thus, the invention provides an electrical contact that is constructed with at least two pieces that are joined together, including a terminus that has a rear termination end and a front portion, and a mater with a front mating end and with a rear portion for fixing to the front portion of the terminus. The front portion of the terminus forms a groove, while the rear portion of the mater has a part that extends into the groove and is locked therein. In one contact, the groove opens radially outward and the part of the terminus that fits in the groove is in the form of a flange that projects radially-inwardly and that has a free radially inward end. In another construction, the groove extends axially and opens forwardly, while the portion of the mater that fits into the groove is in the form of a cylinder. The groove-received portion, whether a radially-extending flange or axially-extending cylinder, preferably lies in a press fit, and may be crimped or even welded in place. While the terminus is formed of a machined piece of stock metal, the mater can be formed of a machined piece of stock metal or a bent piece of sheet metal. Especially for a socket, a piece of sheet metal is preferred. The mater is generally gold plated over its entire surface, while the terminus is not gold plated. It is noted that an underplate of material such as nickel is commonly provided under the gold plate. The provision of separately manufactured terminus and mate elements enables construction of a variety of contacts of slightly different types, by selecting one of a plurality of different termini types and joining it to one of a selected plurality of different mater types.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A contact with a mating end for releaseably mating to another contact and with a termination end for permanent attachment to a conductor, said contact comprising:

a terminus that has an axis and that has front and rear portions spaced along said axis, said rear portion forming said termination end, and said front portion forming a groove;

a mater that has a front portion forming said mating end, said mater having a rear end that fits into said groove and that is locked in said groove to fix said mater to said terminus;

said terminus front portion has a radial inner wall and a radial outer wall, said walls being concentric and radially spaced to form said groove, with said groove opening in an axially forward direction;

said mater rear end has a cylindrical portion with a free rear end that lies in said groove in an interference fit therein.

2. The contact described in claim 1 wherein:

said terminus front portion is crimped around said mater cylindrical portion.

3. The contact described in claim 1 wherein:

said groove has an axial length that is at least equal to the radius of said groove as measured from said axis.

4. A contact comprising:

a terminus that is formed from a machined piece of solid metal and that has a rear end forming a termination end and a front end forming a substantially circular groove that opens forwardly;

a mater that includes a front mating end and that includes a rear end that forms substantially a cylinder of the same diameter as said groove, said cylinder lying in said groove and locked therein;

said terminus has an axis and said groove has radial inner and outer groove walls, with said outer groove wall being deformed to crimp said cylinder between said groove walls.

5. A contact with a mating end for releaseably mating to another contact and with a termination end for permanent attachment to a conductor, said contact comprising:

a terminus that has an axis and that has front and rear portions spaced along said axis, said rear portion forming said termination end, and said front portion having a pair of groove walls forming a groove with primarily parallel groove wall faces;

a mater that has a front portion forming said mating end, said mater having a rear end with a groove-received part that has opposite faces and that fits into said groove and that is sandwiched between said groove walls;

at least one of said pair of groove walls of said terminus front portion is deformed against said groove-received part of said mater rear end to lock said groove-received part in said groove by said pair of groove walls pressing facewise against said opposite faces of said groove-received part.

6. The contact described in claim 5 wherein:

said terminus is formed of a single machined part, said groove is centered on said axis and opens forwardly, and said groove-received part is at least part of a cylinder that lies in said groove.

7. The contact described in claim 5 wherein:

said groove-received part of said mater is of constant thickness, and said groove-walls are spaced apart by about the thickness of said groove-received part.

8. The contact described in claim 5 wherein:

said terminus is formed from a single piece of machined metal, and said mater is formed from a single piece of sheet metal.

9. The contact described in claim 5 wherein:

said groove walls are axially spaced apart and said groove opens radially outward, away from said axis;

said mater rear end has a radially-inwardly projecting flange that extends radially inwardly into said groove.

10. The contact described in claim 5 wherein:

said terminus includes a main part that forms a rearmost one of said axially-spaced groove walls and that has a forwardly-opening hole, and including a fastener (110) that has a front part that forms a frontmost one of said axially-spaced groove walls and that has a shaft that lies in a press fit in said hole.

* * * * *